United States Patent [19]

Cooper

[11] 4,416,426

[45] Nov. 22, 1983

[54] WEB TREATMENT APPARATUS

[75] Inventor: Ronald C. E. Cooper, Brentwood, England

[73] Assignee: Ciba-Geigy AG, Basel, Switzerland

[21] Appl. No.: 285,902

[22] Filed: Jul. 23, 1981

[30] Foreign Application Priority Data

Jul. 31, 1980 [GB] United Kingdom ..... 8025120

[51] Int. Cl.[3] ..... B65H 75/34; B65H 19/04

[52] U.S. Cl. ..... 242/56.9; 242/64; 242/67.3 R

[58] Field of Search ..... 242/56.9, 58.1, 58.2, 242/58.3, 58.4, 58.6, 56 A, 64, 673; 8/151; 26/70, 18.6; 68/5 D, 5 E

[56] References Cited

U.S. PATENT DOCUMENTS 3,448,469 6/1969 Kusters et al. ..... 68/5 D X
3,486,708 12/1969 Lamon ..... 242/64

FOREIGN PATENT DOCUMENTS 3319 1/1979 European Pat. Off. .
892186 3/1962 United Kingdom ..... 26/70

OTHER PUBLICATIONS

Textile Praxis 110–112, Feb. 1971.

*Primary Examiner*—Stuart S. Levy
*Assistant Examiner*—Lloyd D. Doigan
*Attorney, Agent, or Firm*—Harry Falber

[57] ABSTRACT

A rotatable turret with four driven mandrels is described which can be indexed to four positions, a roll load/unload position, a prejoin position, a roll unwind position and a roll rewind position.

By use of this turret three rolls of web material can be coated and dried on each side, each roll having to be loaded and unloaded from the coating machine only once.

4 Claims, 2 Drawing Figures

20
16
19
16
18
21
5
1
2
8
4
10
13
9a
9
3

POSITION D
POSITION A
POSITION C
POSITION B

WEB TREATMENT APPARATUS

This invention relates to a web treatment method.

Nowadays it is common to treat rolls of web material which are over 1 meter wide and which contain several hundred meters length of the web material. Such rolls are extremely bulky and heavy and thus require very expensive and massive handling means.

In a number of web treatment processes it is required that the web be treated on each side thereof. In such a case it is necessary that the web be unwound and rewound twice. This usually doubles the roll handling requirements, the roll having to be taken off the apparatus after one side has been treated and replaced on the apparatus to coat the other side.

We have discovered a web handling method which cuts down to a considerable extent the web handling requirements when webs are to be treated on each side.

According to the present invention there is provided a method of treating a roll of web material by use of a web treatment apparatus which comprises a web treatment section and a rotatable turret having at least three driven mandrels on which rolls of web material may be located, which method comprises placing a roll of web material on one mandrel of the turret, angularly displacing the turret to bring the roll of web material into a position from whence it can be unwound and passed into the web treatment section of the apparatus, unwinding the roll of web material and treating the first side of the web and rewinding the treated web on another mandrel of the turret, angularly displacing the turret to bring the roll into a position from whence it can be unwound and passed into the web treatment section of the apparatus, unwinding the roll of web material and treating the second side of the web, rewinding the web on another mandrel of the turret and angularly displacing the turret to bring the treated roll of web material into a position from whence it may be removed from the apparatus and removing the treated roll from the apparatus.

Most preferably the roll of web material is loaded and unloaded from the same position. This facilitates the location of a cradle or other web roll handling means.

The method of the present invention may be used to treat on each side thereof single rolls of web material. However the apparatus of the present invention is of particular use in the continuous treating up to three rolls of web material. Preferably when so used the turret comprises four mandrels and there are four equi-arc angular displacement positions to which the turret can be indexed. At position A rolls of web material are located in the turret or are removed from the turret. This position is referred to as the loading/unloading position. At position B, which is reached when the turret is indexed by a quarter of the complete arc of rotation of the turret, means are provided to take the leading end of the web on the roll and place it in position for it to be spliced on to the trailing end of the roll already being treated or to splice it on to a dummy web with which the apparatus is usually loaded when web is not being treated. The presence of a dummy web enables the apparatus to start up without having to thread a web therethrough, which can be very time consuming. This second position is referred to as the prejoin position.

Position C is the web unwinding position. This position is reached when the turret is indexed by a further quarter of a complete arc of rotation of the turret. When the web roll is in this position the web is unwound from the roll for treatment in the apparatus.

Position D is the web winding position. This position is reached when the turret is indexed by a further quarter of a complete arc of rotation of the turret. In this position the web is rewound onto a mandrel to form a roll. When the web has been rewound as a roll the turret is indexed by a further quarter of a complete arc of rotation of the turret to bring the rewound roll back to position A.

When the method of the present invention is used to treat continuously web material rolls conveniently three such rolls are treated on one side one after the other, and then these three rolls are treated on the other side in the manner hereinafter described.

Most preferably the turret is caused to rotate in a clockwise direction whilst each of the driven mandrels may be driven either in an anti-clockwise direction or in a clockwise direction. This arrangement enables a web which has been treated on one side to be wound up treated side inwards so that the untreated surface is presented for treatment when the web is unwound and passed for the second time through the treatment section of the apparatus.

The method of the present invention if of particular use in the coating and drying of web material on each side thereof. For example photographic film material suitable for radiography is coated on each side with a layer of photographic silver halide emulsion. Each layer must be dried before the web is rewound as a roll.

The accompanying drawings will serve to illustrate the method of the invention.

In FIG. 2 position A, B, C and D on the rotatable turret are indicated.

Figure 1:
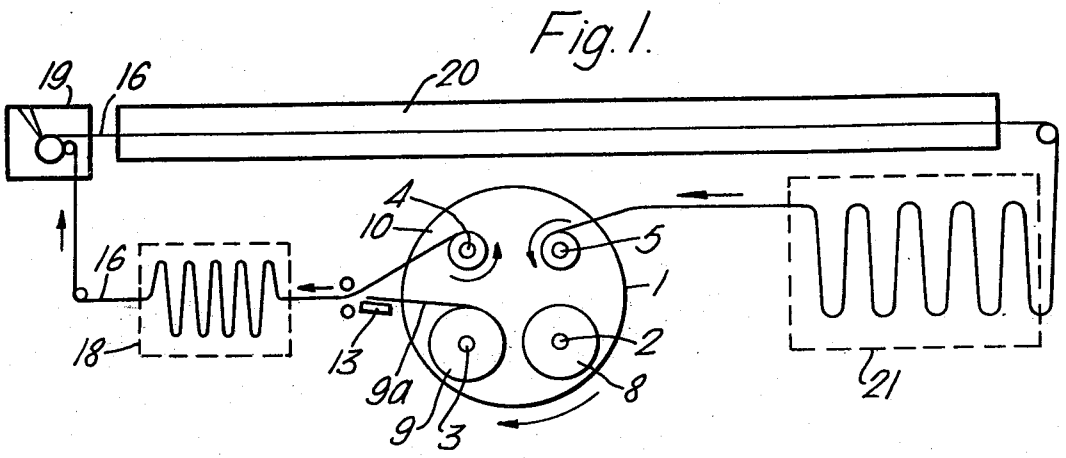
FIG. 1 is a diagrammatic layout of an apparatus of use in the present invention.
Figure 2:
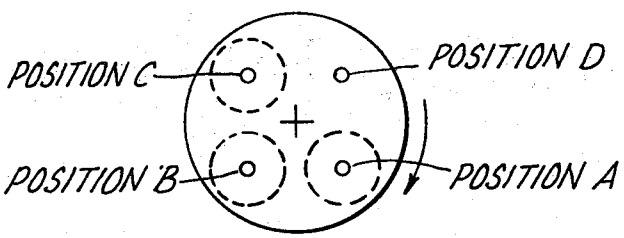
FIG. 2 is a diagrammatic end view of the rotatable turret shown in FIG. 1 and defines the four positions into which any mandrel can be brought.

In FIG. 1 there is shown a web coating and drying apparatus. The apparatus comprises a rotatable turret 1 having four driven mandrels 2, 3, 4 and 5 on which are located three rolls of web material 8, 9, and 10. In FIG. 1 roll 8 is shown in position A (as shown in greater detail in FIG. 2) having just been located in the apparatus. Roll 9 is shown in the prejoin position, position B. The leading end 9*a* of this roll is shown in the prejoin position 13, position B.

The web from roll 10 is partially in the web unwinding position, position C, and partially in the web winding position, position D. Thus the web 16 from roll 10 is shown following a circuitous path through the web treatment section of the apparatus. The sections through which web 16 passes are an air float magazine 18, a coating section 19, a drying section 20 and another air float magazine 21. Arrows indicate the direction in which the turret 1 rotates and the path of the web.

It is to be understood that in general use a dummy web will be present in the web treatment section because the lacing up of a web in this section is very time consuming, so unless a web breaks or there is a major shut down there will always be a web in the treatment section of the apparatus.

To commence coating a roll of web material, in this case roll 10, is placed in position A. The turret 1 is then indexed by a quarter of an arc of rotation to bring roll 10 into position B. In this position the leading end of the web of roll 10 is spliced on to the trailing end of the dummy web. The web is then caused to unwind from the mandrel by the various drive rollers located in the apparatus and by the driven mandrel which is present in position D.

The roll of web material 9 is then located in the turret in position A.

The web from roll 10 follows the dummy web through the apparatus and when several meters of web material have been unwound from the roll the turret is indexed by a quarter of a full rotation. This brings roll 10 into position C, the unwinding position, and brings roll 9 into position B, the prejoin position.

Roll 8 is then located in the turret in position A and the condition of the apparatus then corresponds to FIG. 1.

The web from roll 10 will then be treated on one side and wound on to the mandrel in position D until it is almost fully wound on to this mandrel. At this point the web will be almost fully unwound from the mandrel in position C and the trailing end of the web on this mandrel is spliced to the leading end of the web on the mandrel in position B. When this splice has been made the turret is indexed a quarter of a rotation bringing roll 10 into position A, roll 9 into position C and roll 8 into position B. Roll 10 continues to wind up in position A on the mandrel 5 in this position and when it is fully wound up the web is cut and the web from roll 9 is then wound up on the mandrel in position D. The winding up on this mandrel continues until roll 9 is almost fully unwound from the mandrel in position C, then the trailing end of this web is spliced to the leading end of the web of roll 8, the turret is indexed a quarter of a turn bringing roll 10 into the prejoin position, position B, and roll 9 into position A where it is fully wound up and detached from the web of roll 8 which is then wound up on the mandrel in position D.

Treatment of the web of roll 8 continues until it is almost fully unwound from the mandrel in position C. Then the leading end of the web of roll 10 is spliced to the trailing end of the web of roll 8. The web from roll 10 is then fed through the treatment section of the apparatus to treat the other side of the web to that treated the first time the web was fed through the treatment section of the apparatus. Roll 10 in indexed into position C where it is unwound and fed through the treatment section of the apparatus and rewound on the mandrel in position D. Then when it is almost fully rewound in position D the roll is indexed to position A and the trailing end is detached from the web of roll 9 which is then being treated. Roll 10 is then removed from the turret in position A and a fresh roll of web material is placed in this position. The webs of rolls 9 and 8 are similarly treated on their sides not treated during the first time they were fed through the apparatus and after being wound up are removed from position A, being replaced by fresh rolls or when the roll treatment is required to be shut down by a dummy roll which is fed through the apparatus but not treated.

It is to be understood that treatment of the web on a single passage through the apparatus may comprise the application of one coated layer, a plurality of layers or none.

The invention is of wide applicability and treatment is specifically intended to include chemical processing, coating, conditioning, mechanical and photographic printing, calendering, inspection and cleaning.

We claim:

1. Method of treating a roll of web material by use of a web treatment apparatus which comprises a web treatment section and a rotatable turret having at least three driven mandrels on which rolls of web material may be located, which method comprises placing a roll of web material on one mandrel of the turret, angularly displacing the turret to bring the roll of web material into a position from whence it can be unwound and passed into the web treatment section of the apparatus, unwinding the roll of web material and treating the first side of the web and rewinding the treated web on another mandrel of the turret, angularly displacing the turret to bring the roll into a position from whence it can be unwound and passed into the web treatment section of the apparatus, unwindiang the roll of web material and treating the second side of the web, rewinding the web on another mandrel of the turret and angularly displacing the turret to bring the treated roll of web materials into a position from whence it may be removed from the apparatus and removing the treated roll from the apparatus.

2. A method of treating web material according to claim 1 wherein the web material is loaded and unloaded from the same angular displacement position of the rotatable turret.

3. A method of treating rolls of web material by use of a web treatment apparatus which comprises a web treatment section and a rotatable turret having four driven mandrels on which rolls of web material may be located and four equi-arc angular displacement positions to which said turret may be indexed, which method comprises placing, in turn, three rolls of web material on three of the mandrels of the turret and subjecting each of the three rolls, in sequence and continuously, to each of the following steps: angularly displacing the turret to bring the roll of web material into a position from whence it can be unwound and passed into the web treatment section of the apparatus, unwinding the roll of web material and treating the first side of the web and rewinding the treated web on another mandrel of the turret, angularly displacing the turret to bring the roll into a position from whence it can be unwound and passed into the web treatment section of the apparatus, unwinding the roll of web material and treating the second side of the web, rewinding the web on another mandrel of the turret and angularly displacing the turret to bring the treated roll of web materials into a position from whence it may be removed from the apparatus and removing the treated roll from the apparatus.

4. A method of treating web material according to claim 3 wherein each web material is loaded and unloaded from the same angular displacement position of the rotatable turret.

* * * * *